US008172471B2

(12) United States Patent
Honda

(10) Patent No.: US 8,172,471 B2
(45) Date of Patent: May 8, 2012

(54) RIBBON CARTRIDGE FOR PRINTING

(75) Inventor: Yoshito Honda, Fujisawa (JP)

(73) Assignee: International Business Machines Corporation, Armonk, NY (US)

( * ) Notice: Subject to any disclaimer, the term of this patent is extended or adjusted under 35 U.S.C. 154(b) by 952 days.

(21) Appl. No.: 12/181,439

(22) Filed: Jul. 29, 2008

(65) Prior Publication Data

US 2009/0041526 A1 Feb. 12, 2009

(30) Foreign Application Priority Data

Aug. 7, 2007 (JP) ..... 2007-205963

(51) Int. Cl.

| | |
|---|---|
| ***B41J 33/32*** | (2006.01) |
| ***B41J 35/04*** | (2006.01) |
| ***B41J 35/08*** | (2006.01) |

(52) U.S. Cl. ..... 400/248; 400/196; 400/196.1; 400/247

(58) Field of Classification Search ..... 400/194, 400/195, 196, 196.1, 208, 247, 248, 248.1
See application file for complete search history.

(56) References Cited

U.S. PATENT DOCUMENTS

| | | | | |
|---|---|---|---|---|
| 4,091,168 | A * | 5/1978 | Kawamata | 428/416 |
| 4,284,364 | A * | 8/1981 | Rello | 400/234 |
| 4,632,583 | A * | 12/1986 | Nash | 400/248 |
| 5,366,304 | A * | 11/1994 | Sheehan et al. | 400/248 |

FOREIGN PATENT DOCUMENTS

| | | |
|---|---|---|
| JP | 6333106 A | 12/1994 |
| JP | 2005-280212 | 10/2005 |

* cited by examiner

*Primary Examiner* — Matthew G Marini
*Assistant Examiner* — Marissa Ferguson Samreth
(74) *Attorney, Agent, or Firm* — Hoffman Warnick LLC; Andrea Bauer

(57) ABSTRACT

A ribbon cartridge for a printer. The ribbon cartridge including a simple mechanism that prevents an ink ribbon from being twisted or excessively drawn out in mounting thereof. Provided is a ribbon cartridge for printing, which includes: an ink ribbon; a cartridge main body which stores the ink ribbon so as to expose a part of the ink ribbon; a ribbon guide which is engaged with the exposed part of the ink ribbon so as to guide the exposed part; and a guide tape which forms a loop so as to support the ribbon guide while having one end in its longitudinal direction fixed to a first position on the ribbon guide and having the other end fixed to a second position on the ribbon guide and which is disposed so that a surface of the guide tape can face a surface of the exposed part of the ink ribbon.

16 Claims, 8 Drawing Sheets

(A)

(B)

RIBBON CARTRIDGE FOR PRINTING

FIELD OF THE INVENTION

The present invention relates to a ribbon cartridge which is used by being mounted on a printer or the like and stores an ink ribbon therein. Moreover, the present invention relates to a printer or the like which has the ribbon cartridge mounted thereon.

BACKGROUND OF THE INVENTION

Currently used printers can be classified into various types according to the printing methods used. Among those printers, what is termed as an impact printer performs printing by pressing an ink ribbon impregnated with ink on a paper sheet, and thus by transferring the ink to the paper sheet. The impact printer is also used widely now to make prints on carbon or pressure-sensitive multi-sheet business forms particularly.

More specifically, in the impact printer, a part of the ink ribbon impregnated with ink is disposed so that a face of the ink ribbon can be parallel to the printing surface of the paper sheet. Moreover, pins are driven out of a print head disposed opposite to the paper so that the ink ribbon is interposed in between, and thereby make the ink ribbon collide with (impact on) the paper sheet. Accordingly, the ink is transferred to the paper sheet only at spots where the ink ribbon comes into contact with the paper sheet. Thus, the impact printer makes prints by repeating the above operation at high speed.

The ink ribbon is generally an endless ribbon having one end and the other end connected to each other, and most of the ribbon is stored in a cartridge main body. Moreover, parts of the ink ribbon required for printing, in other words, sufficiently impregnated with ink are sequentially drawn out (fed) from one end of the cartridge main body. Then, after being used for printing, those parts of the ink ribbon are sequentially re-stored into the cartridge main body from the other end of the cartridge main body.

In other words, a part of the entire ink ribbon having a certain length is always exposed to the outside of the cartridge main body. Moreover, as printing advances, the exposed part in the entire ink ribbon is sequentially shifted.

One place of the exposed part of the ink ribbon is engaged with a component called a ribbon guide so that the ink ribbon can slide through the ribbon guide. Specifically, the ribbon guide has a function to support the exposed part of the ink ribbon and to guide the movement of the ink ribbon after being drawn out and until being restored.

By fixing the ribbon guide to the print head in the printer or the like, the ribbon guide reciprocates with the reciprocating movement of the print head inside the printer or the like, while guiding the ink ribbon. During such reciprocation, a part of the ink ribbon (hereinafter referred to as a "printing part") that is supported by the ribbon guide and is located close to the print head is brought into contact with the paper sheet by the print head. Thus, printing is performed.

The cartridge main body, the ribbon guide and the ink ribbon, which is set in the cartridge main body and has the ribbon guide engaged therewith, will be hereinafter collectively referred to as a "ribbon cartridge."

FIGS. 1A and 1B show a conventional typical ribbon cartridge 100.

In a conventional impact printer, a cartridge main body 104 which stores therein most of an ink ribbon 102, and a ribbon guide 106 engaged with a drawn-out (exposed) part of the ink ribbon 102 are mounted separately from each other in the printer. For this reason, in loading or replacement of the ribbon cartridge, there are problems such as twisting of the ink ribbon (see FIG. 1A) and excessive drawing-out of the ink ribbon (see FIG. 1B).

In the case where the ribbon guide is mounted and printing is started while the ink ribbon is left twisted, a crucial problem for the printer occurs that "proper printing cannot be performed," when the twisted portion comes to a printing part 108.

Moreover, in the case where the twisted portion is stored in the cartridge main body 104, ribbon feed may no longer be performed. This is because the twisted ink ribbon is so narrow that the ribbon enters a rotating part of a ribbon feed mechanism in the printer and gets jammed therein.

In either case, there arises a situation in which the ink ribbon has to be replaced together with the ribbon cartridge 100.

Moreover, when the ink ribbon is excessively drawn out from the cartridge main body, the drawn-out and exposed ink ribbon needs to be stored manually so as to set the ink ribbon to a proper length. In this event, the ink ribbon is likely to be twisted. Thus, the ribbon cartridge is more likely to be mounted on the printer while the ink ribbon is left twisted.

In order to deal with such problems, there is a ribbon cartridge product as described below.

FIG. 2 shows this product. In a ribbon cartridge 200 shown in FIG. 2, a cartridge main body 202 and a ribbon guide 204 are connected to each other by use of a plastic bellows 206. Then, an ink ribbon slides inside the bellows. Thus, the ink ribbon is never twisted.

However, the bellows requires an extra space in a horizontal direction. Thus, the cartridge main body has to be reduced in size, and accordingly an overall length of the ink ribbon has to be reduced. As a result, the life of the ribbon cartridge becomes shorter than that of a conventional product.

Moreover, since the ink ribbon slides inside the bellows, this product requires a greater force to feed the ink ribbon due to friction between the bellows and the ink ribbon than the conventional product. Furthermore, cost is increased for the bellows. Thus, this product is not a high-value product.

In Japanese Patent Application Laid-open Publication No. 2005-280212, the following invention related to a ribbon cartridge is described. Specifically, a cartridge main body and a ribbon guide are engaged with each other in a brand-new condition. Then, also when the cartridge main body and the ribbon guide are mounted on a printer, the ribbon guide is attached to a predetermined position in the printer while the cartridge main body and the ribbon guide are still engaged with each other. Thus, twisting of a ribbon is prevented.

In this method, the cartridge main body is subsequently detached from the ribbon guide and mounted on a predetermined position in the printer. Accordingly, the method described above is effective in mounting a brand-new ribbon cartridge. However, the method is not effective in the following case during use of the printer. For example, the ribbon guide is detached from a print head together with the ink ribbon due to paper sheet jam or the like, and then the ribbon guide is attached to the printer again.

In other words, once the ribbon cartridge is mounted on the printer, the cartridge main body and the ribbon guide are attached to the printer separately from each other. Thus, when the ribbon guide is afterward detached from the printer due to the paper sheet jam or the like, the ink ribbon is likely to be twisted. Thus, there still remains a problem that the ribbon guide is re-attached while the ink ribbon is left twisted.

As described above, the conventionally used ribbon cartridge always has the problem of the twisted ink ribbon. Accordingly, it is a current situation that an operator has to take measures with enough care so as not to cause twisting of the ink ribbon in manually attaching and detaching the ribbon guide and the like to and from the printer.

SUMMARY OF THE INVENTION

The present invention was made to solve the current problems described above concerning a ribbon cartridge for a printer or the like. The present invention provides a ribbon cartridge including a simple mechanism that prevents an ink ribbon from being twisted or excessively drawn out in attachment and detachment thereof to and from a printer or the like.

According to an aspect of the present invention, there is provided a ribbon cartridge for printing, which comprises: an ink ribbon; a cartridge main body which stores the ink ribbon so as to expose a part of the ink ribbon; a ribbon guide which is engaged with the exposed part of the ink ribbon so as to guide the exposed part; and a guide tape which forms a loop so as to support the ribbon guide while having one end in its longitudinal direction fixed to a first position on the ribbon guide and having the other end fixed to a second position on the ribbon guide and which is disposed so that a surface of the guide tape can face a surface of the exposed part of the ink ribbon.

According to the present invention, there are also provided a printer and a multiple functions peripheral with a printing function, which include the ribbon cartridge.

BRIEF DESCRIPTION OF THE DRAWINGS

For a more complete understanding of the present invention and the advantage thereof, reference is now made to the following description taken in conjunction with the accompanying drawings.

DETAILED DESCRIPTION OF THE INVENTION

Figure 1:
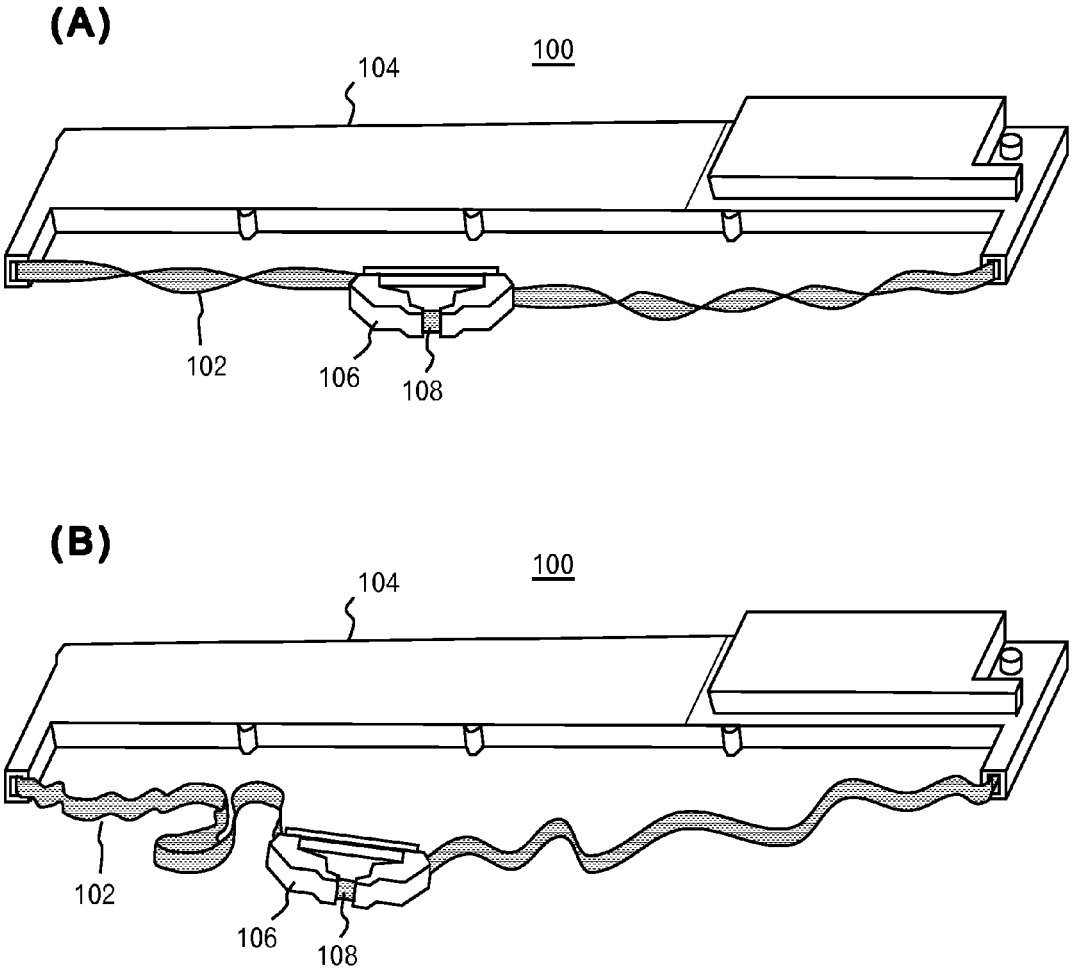
FIG. 1 Related Art
FIGS. 1A and 1B show a ribbon cartridge according to a conventional technology.
Figure 2:
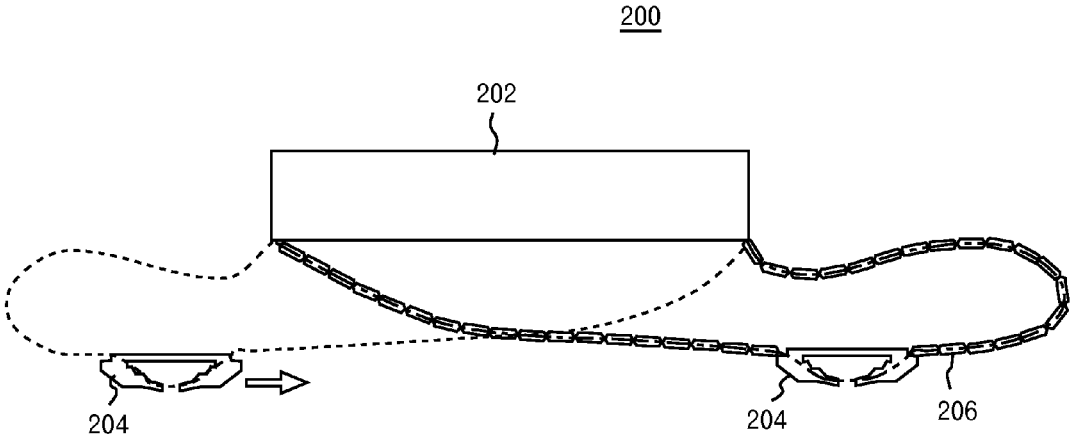
FIG. 2 Related Art
FIG. 2 shows a ribbon cartridge according to a conventional technology.

With reference to the accompanying drawings, the present invention (hereinafter referred to as embodiments) will be described in detail below. Note that, throughout the description of embodiments, the same elements will be denoted by the same reference numerals.

A first embodiment of the present invention will be described.

Figure 3:
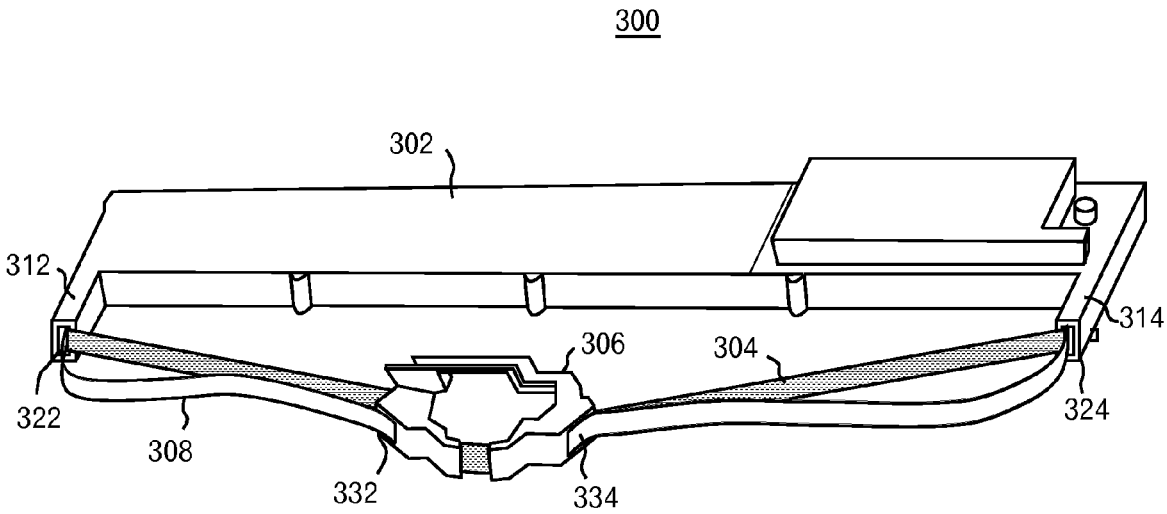
FIG. 3 shows a perspective view of an entire ribbon cartridge according to a first embodiment of the present invention.
Figure 4:
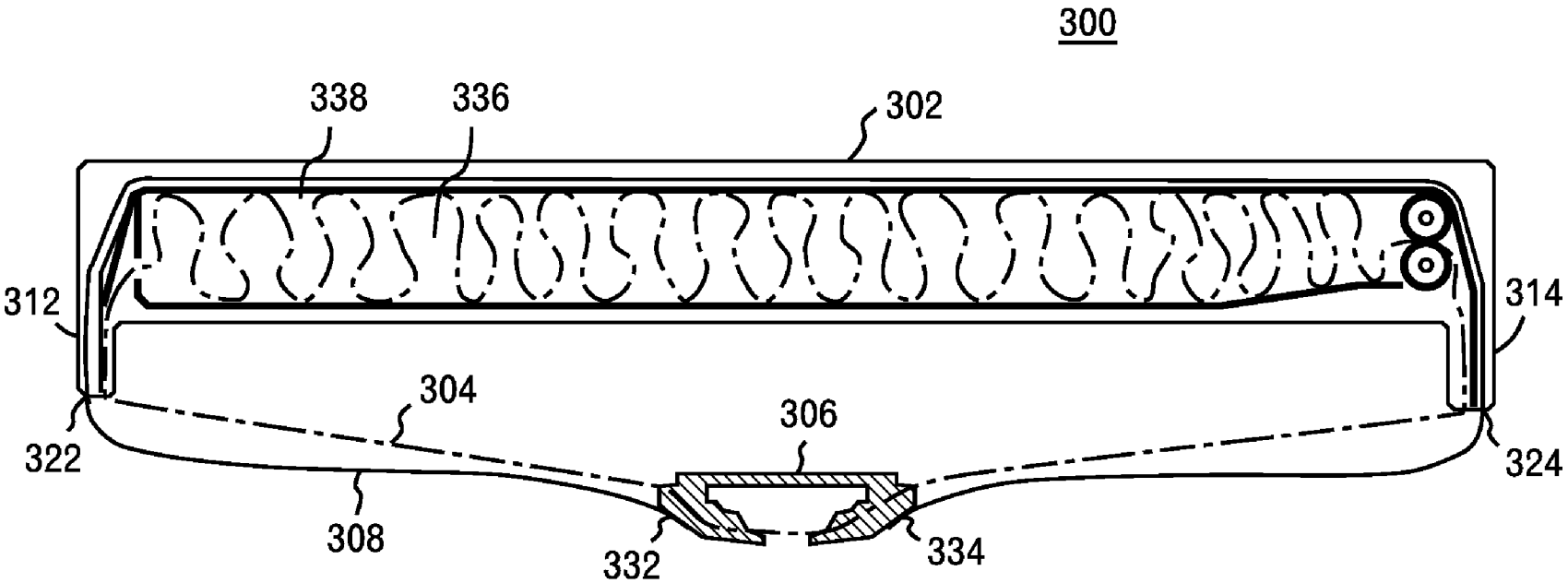
FIG. 4 shows a cross-sectional view of the ribbon cartridge according to the first embodiment of the present invention.

FIG. 3 shows a perspective view of an entire ribbon cartridge according to the first embodiment of the present invention. FIG. 4 shows a cross-sectional view of the ribbon cartridge according to the first embodiment of the present invention. As shown in FIGS. 3 and 4, a ribbon cartridge 300 includes a cartridge main body 302. In the cartridge main body 302, most of an ink ribbon 304 that is an endless ribbon having one end and the other end connected to each other is stored while being folded in many layers.

On both ends of the cartridge main body 302, protrusions 312 and 314 are provided. The ink ribbon 304 is exposed by being drawn out from an opening 322 at a tip of the protrusion 312 and is stored again in the cartridge main body 302 from an opening 324 at a tip of the protrusion 314. A ribbon guide 306 is engaged with a spot of the exposed portion of the ink ribbon 304. The ink ribbon 304 can slide through the ribbon guide 306.

The ribbon cartridge 300 further includes a guide tape 308 that is a tape-like film having the same width as that of the ink ribbon 304 or a width larger than that of the ink ribbon. The guide tape 308 forms a loop so as to support the ribbon guide 306 by fixing one end thereof in its longitudinal direction to a first position 332 at a left end of the ribbon guide 306 and fixing the other end thereof to a second position 334 at a right end of the ribbon guide 306.

Moreover, the guide tape 308 is disposed so as to maintain a positional relationship that a tape surface thereof faces a ribbon surface in the exposed portion of the ink ribbon 304. In order to facilitate the disposition of the guide tape, the guide tape 308 passes the inside of the cartridge main body 302 through the same openings 322 and 324 as those through which the ink ribbon 304 enters and exits from the cartridge main body 302. Moreover, the guide tape 308 takes a path surrounding a path of the ink ribbon 304 so that the ink ribbon 304 can be disposed within the loop formed by the guide tape 308.

With reference to FIG. 4, in the cartridge main body 302, a storage part 336 for the ink ribbon 304 and a passage of the guide tape 308 are separated from each other by a partition wall 338. Moreover, the guide tape 308 is supported by the partition wall 338 and can slide along a path immediately outside the partition wall 338.

A material to form the guide tape 308, it is desirable to use a plastic sheet material or the like, which has elasticity and is less likely to be broken. Specifically, when the ribbon guide 306 is rotated in the width direction of the ink ribbon 304 and the ink ribbon 304 is forced to be twisted, the guide tape 308 is also forced to be twisted at the same time. However, the guide tape 308 tries to return to its original state by the elasticity thereof. Thus, the ink ribbon 304 is never twisted after all.

Moreover, the outside of the ink ribbon 304 is surrounded by the loop-shaped guide tape 308 that does not expand and contract. Thus, a problem that the ink ribbon 304 is excessively drawn out is also solved.

Furthermore, even if the ribbon guide 306 is moved from side to side, the guide tape 308 slides along the path inside the cartridge main body 302 in accordance with the movement of the ribbon guide. Thus, the guide tape 308 is not significantly bent by its horizontal movement. Moreover, a space in which the ribbon guide 306 can be moved from side to side is the same as that in the case of the conventional ribbon cartridge.

Next, description will be given of a mode of using the ribbon cartridge according to the present invention mounted on a device.

The following description will be given by adopting a printer as the device on which the ribbon cartridge according to the present invention is mounted and used. However, needless to say, the device is not limited to a printer having only a print function. Specifically, a multiple functions peripheral (MFP) including, in addition to the print function, various functions other than the print function (for example, a facsimile function, an image scanner function, a telephone function and the like) can be generally used as the device on which the ribbon cartridge according to the present invention is mounted and used.

Figure 5:
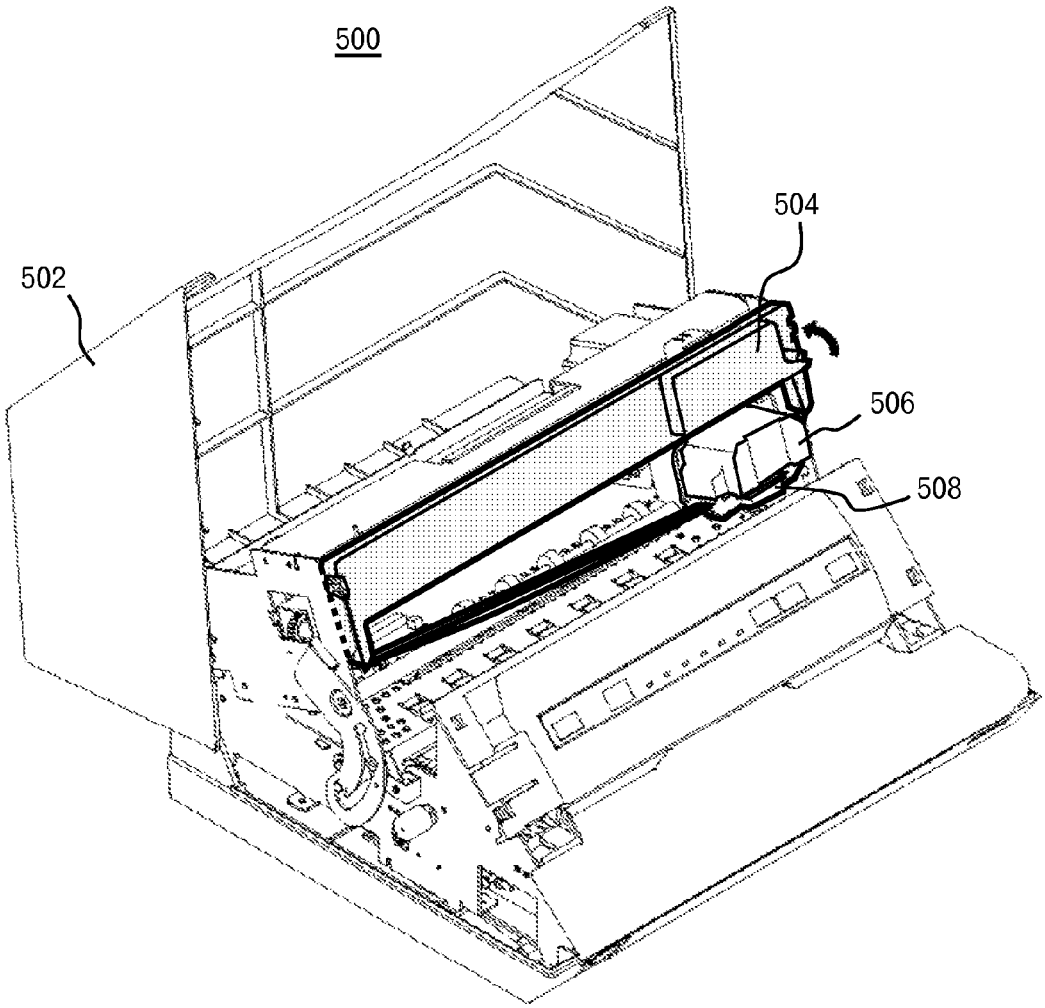
FIG. 5 shows a state where a ribbon cartridge according to the present invention is mounted on a printer.

FIG. 5 is a perspective view showing an overall picture of a state where a ribbon cartridge according to the present invention is mounted on the printer.

Generally, procedures for mounting the ribbon cartridge are as follows. Specifically, first, a cartridge main body 504 is mounted on a predetermined position inside a printer 500 after a cover 502 for the printer is opened. Thereafter, a ribbon guide 508 that can move against the fixed cartridge main body 504 is attached to a predetermined position on a print head 506 in the printer and fixed thereto. Thus, the procedures are completed.

Then, after the cover 502 is closed and the operation of the printer starts, the print head 506 starts reciprocating movement for printing. With this reciprocating movement, the ribbon guide 508 fixed on the print head 506 correspondingly moves from side to side within its movable range.

Figure 6:
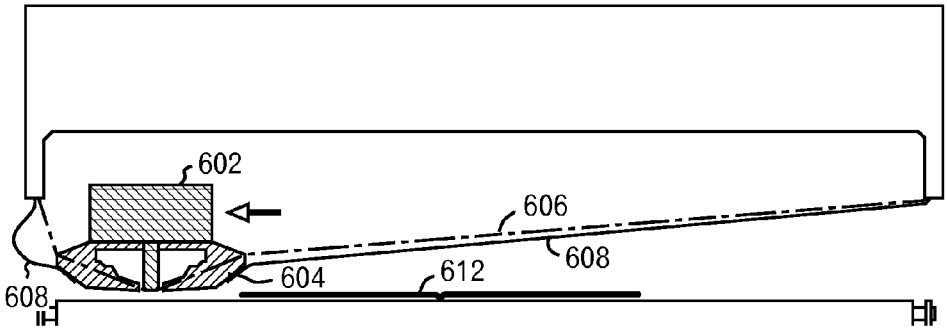
FIGS. 6A and 6B show a change in a state of a ribbon cartridge according to the present invention, which is mounted on the printer.
Figure 6:
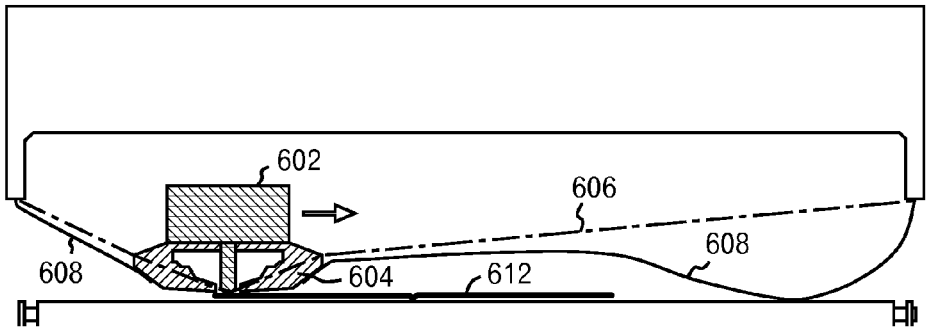

FIGS. 6A and 6B show how a state of a guide tape, in a ribbon cartridge according to the present invention which is mounted on a printer, is changed depending on a position of a print head.

As shown in FIG. 6A, when a ribbon guide 604 comes to a left end within its movable range along with movement of a print head 602 to the left end, a guide tape 608 is not bent at the right side of the ribbon guide 604 due to resistance in slide movement and is set approximately parallel to an ink ribbon 606. The guide tape 608 is slightly bent at the left side of the ribbon guide 604, which, however, does not cause any problem in use. The same goes for the case where the ribbon guide 604 comes to a right end within its movable range. When a paper sheet 612 or the like is inserted, the print head 602 is always positioned at the right or left end. Thus, the guide tape 608 never interferes with the paper sheet 612 or the like.

As shown in FIG. 6B, when the ribbon guide 604 is moved toward the right side, the guide tape 608 is bent at the right side of the ribbon guide 604 and is not bent due to resistance in slide movement at the left side of the ribbon guide. Here, if the paper sheet 612 or the like has a large width, the bent portion of the guide tape 608 may come into contact with the paper sheet 612 or the like. However, the guide tape 608 touches the paper sheet lightly and does not affect print quality or a line feed operation for the paper sheet. The same goes for the case where the ribbon guide 604 is moved toward the left side.

Next, a second embodiment of the present invention will be described.

Figure 7:
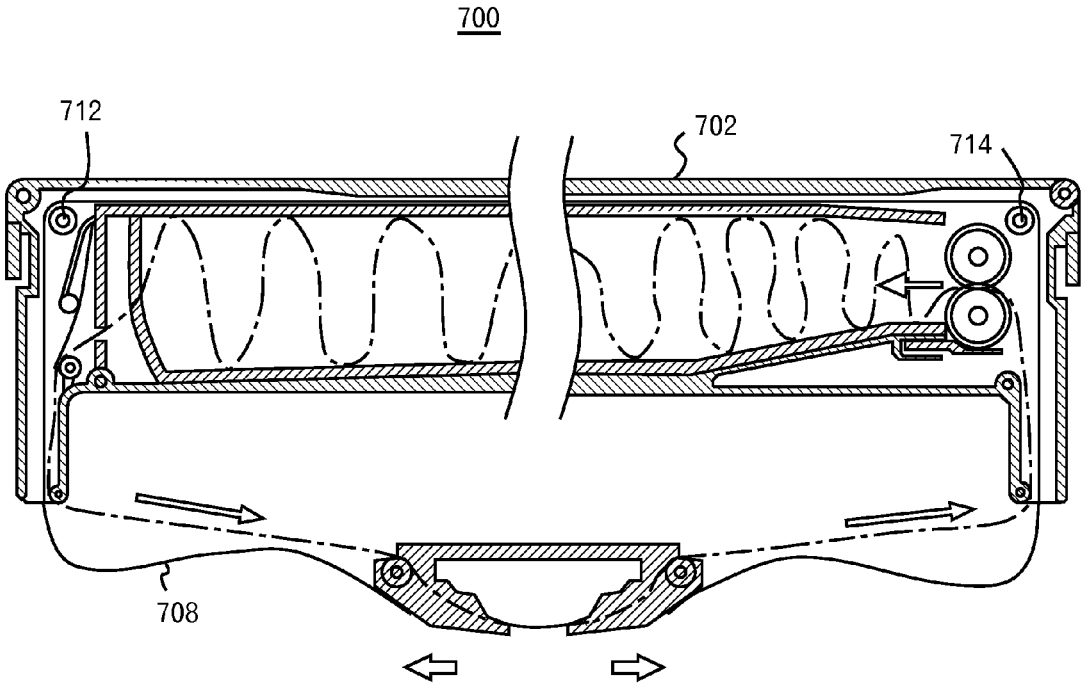
FIG. 7 shows a cross-sectional view of a ribbon cartridge according to a second embodiment of the present invention.

FIG. 7 shows a cross-sectional view of a ribbon cartridge 700 according to the second embodiment of the present invention.

In the ribbon cartridge 300 according to the first embodiment shown in FIG. 4, the partition wall 338 is provided between the storage part 336 for the ink ribbon 304 and the passage of the guide tape 308 in the cartridge main body 302. Since the partition wall 338 made of plastic or the like and the guide tape 308 come into contact with each other, some resistance is generated in slide movement of the guide tape 308.

Therefore, in the second embodiment of the present invention, as shown in FIG. 7, guide rollers 712 and 714 are installed at two spots on a path of a guide tape 708 inside a cartridge main body 702. Moreover, the guide tape 708 is put on the guide rollers 712 and 714, and thus is guided to pass outside the guide rollers 712 and 714.

With such a configuration, resistance in slide movement of the guide tape 708 can be significantly reduced. For the guide rollers 712 and 714, an inexpensive material such as plastic can be used. Moreover, the same material as that already used for the ribbon guide can also be used. Thus, in terms of functionality, durability and the like, sufficient reliability can be secured.

Furthermore, a third embodiment of the present invention will be described.

Figure 8:
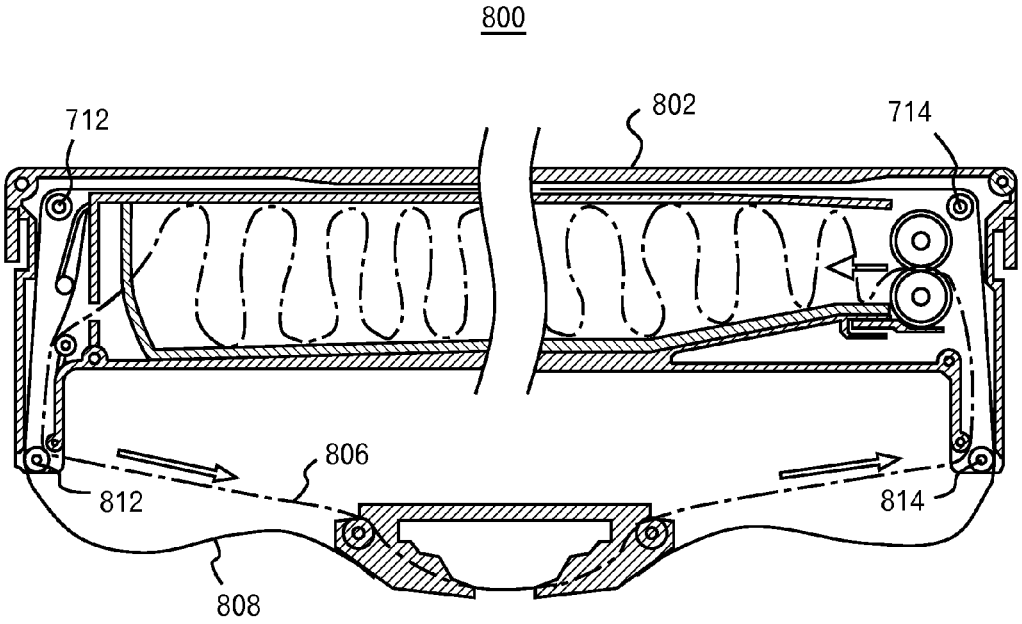
FIG. 8 shows a cross-sectional view of a ribbon cartridge according to a third embodiment of the present invention.

FIG. 8 shows a cross-sectional view of a ribbon cartridge 800 according to the third embodiment of the present invention. In the ribbon cartridge 700 according to the second embodiment shown in FIG. 7, the two guide rollers 712 and 714 are installed for smooth slide movement of the guide tape 708. Meanwhile, in the ribbon cartridge 800 according to the third embodiment, additional guide rollers 812 and 814 are further installed near two openings in a cartridge main body 802, through which an ink ribbon 806 enters and exits.

By installing the four guide rollers 712, 714, 812 and 814 in total as described above, resistance caused by slide movement of a guide tape 808 can be further reduced.

Next, description will be given of examples of an optimum material of the guide tape for implementing the first to third embodiments of the present invention.

It is desirable that the guide tape according to the present invention normally has a certain level or more of strength with respect to abrasion resistance or the like due to its use.

Moreover, the guide tape forms a loop by fixing its both ends in its longitudinal direction to the ribbon guide, respectively. The guide tape is also put on the guide rollers and changes a direction thereof. Furthermore, the guide tape slides along the loop in accordance with horizontal movement of the ribbon guide. Thus, the guide tape has to be sharply turned on the portion in contact with the guide rollers and has to be approximately straight in other spots. Consequently, it is desirable that the guide tape also has a certain level or more of elasticity.

Table 1 shows typical film materials and physical property values thereof.

Among the film materials shown in Table 1, a polyimide material is "KAPTON" (registered trademark) manufactured by Du Pont-Toray Co., Ltd. and property values thereof are rupture strength: 170 MPa, rupture elongation: 70% and Young's modulus: 3 GPa.

Here, "rupture strength" and "rupture elongation" are physical properties indicating strength. The "rupture strength" is a value indicating how much force is required to rupture the guide tape. Moreover, the "rupture elongation" is a value indicating how much (about what percentages of the total) the guide tape is elongated until ruptured. The larger the both values, the more suitable as the material of the guide tape according to the present invention.

"Young's modulus" is a physical property indicating elasticity. A larger "Young's modulus" means that the material has higher elasticity and a smaller "Young's modulus" means that the material is fragile and likely to be broken. The larger the value, the more suitable as the material of the guide tape according to the present invention.

TABLE 1

| Type | Item Unit | Density g/cm$^3$ | Melting point ° C. | Processing temperature range ° C. | Rupture strength MPa | Rupture elongation % | Young's modulus GPa |
|---|---|---|---|---|---|---|---|
| Polyimide | | 1.42 | | −269 to 400 | 170 | 70 | 3 |
| Biaxially oriented polyester | | 1.40 | 263 | −70 to 180 | 210 | 130 | 4 |
| Biaxially oriented PPS | | 1.35 | 285 | −269 to 200 | 200 | 70 | 4 |
| Non-oriented polypropylene | | 0.89 | 160 to 170 | up to 121 | 30 to 50 | 700 | 0.7 |
| Hard polyvinyl chloride | | 1.4 | 170 | 70 | 50 | 30 to 130 | 1.4 |
| Acetate (Cellulose triacetate) | | 1.25 to 1.35 | 290 | −18 to 121 | 130 | 40 | 3 |
| polycarbonate | | 1.2 | 222 to 230 | −73 to 129 | 100 | 150 | 1.1 |
| Biaxially oriented nylon | | 1.14 | 223 | −46 to 177 | 240 | 100 | 1.7 |
| Non-oriented nylon | | 1.13 | 223 | | 100 | 400 | 0.6 |

The following is a result of a life test for the guide tape performed by using "KAPTON" as the material of the guide tape, forming the ribbon cartridge according to the first embodiment and mounting the ribbon cartridge on the printer.

Life Test

Continuous Printing:

The number of print lines specified as the life of ink ribbon or more were printed.

Points to be Checked After Test

Hardly any abrasion in guide tape

No scratch and fold in guide tape

Hardly any abrasion in cartridge main body

No abnormal movement due to abrasion powder

Conclusion

Ribbon cartridge can be used without any problem even after the life of ink ribbon has come to end.

It can be said from the result shown above that the physical properties of "KAPTON" that is the polyimide material as the film material are desirable as the material of the guide tape included in the ribbon cartridge according to the present invention.

The higher the strength and elasticity of the film material, the more desirable as the material of the guide tape according to the present invention. Thus, it is desirable after all that the physical property values for the strength and elasticity that the guide tape according to the present invention should at least satisfy all the following conditions:

Rupture strength: 170 MPa or more;

Rupture elongation: 70% or more; and

Young's modulus: 3 GPa or more

Among the various film materials shown in Table 1, biaxially oriented polyester material and biaxially oriented PPS (polyphenylene sulfide) material, besides polyimide material, also satisfy the foregoing conditions of strength and elasticity. Thus, ribbon cartridges formed by using those materials as the material of the guide tape can be desirable as the ribbon cartridge according to the present invention.

The ribbon cartridge according to the present invention can prevent the ink ribbon from being twisted or excessively drawn out in attachment and detachment thereof to and from the printer or the like. Moreover, the ribbon cartridge according to the present invention has an advantage that the ribbon cartridge has a relatively simple structure obtained by adding only the guide tape to that of the conventional technology, and can be mounted at low cost.

Although the present invention has been described above by use of the several embodiments, the present invention can be implemented by use of more various embodiments. The invention according to the scope of claims is not limited by the foregoing embodiments. Specifically, it is apparent to those skilled in the art that various changes or modifications can be added to the foregoing embodiments.

Moreover, it is apparent from the description of the scope of claims that embodiments to which such changes or modifications are added can also be included in the technical scope of the present invention.

Furthermore, it should be noted that all combinations of features described in the embodiments are not necessarily essential to the solving means of the present invention.

What is claimed is:

1. A ribbon cartridge for printing, comprising:

an ink ribbon;

a cartridge main body which stores the ink ribbon so as to expose a part of the ink ribbon;

a ribbon guide which is engaged with the exposed part of the ink ribbon so as to guide the exposed part; and a guide tape which forms a loop so as to support the ribbon guide while having one end in a longitudinal direction fixed to a first position on the ribbon guide and having the other end fixed to a second position on the ribbon guide and which is disposed so that a surface of the guide tape can face a surface of the exposed part of the ink ribbon;

wherein the guide tape passes through the cartridge main body.

2. The ribbon cartridge according to claim 1, wherein:

the ink ribbon is exposed from the cartridge main body through a first opening and a second opening in the cartridge main body; and the guide tape passes inside the cartridge main body through the first and second openings.

3. The ribbon cartridge according to claim 1, wherein the ink ribbon is disposed inside the loop formed by the guide tape.

4. The ribbon cartridge according to claim 1, wherein the cartridge main body has a partition wall between a storage part for the ink ribbon and a passage of the guide tape.

5. The ribbon cartridge according to claim 1, wherein:

the cartridge main body further includes one or more guide rollers: and each of the guide rollers guides the guide tape passing inside the cartridge main body.

6. The ribbon cartridge according to claim 1, wherein a tape width of the guide tape is at least as large as a ribbon width of the ink ribbon.

7. The ribbon cartridge according to claim 1, wherein the guide tape comprises a material selected from a group consisting of polyimide, biaxially oriented polyester, and biaxially oriented PPS (polyphenylene sulfide).

8. The ribbon cartridge according to claim 1, wherein the guide tape has a rupture strength of not less than 170 MPa, a rupture elongation of not less than 70%, and a Young's modulus of not less than 3 GPa.

9. A multiple functions peripheral having a printing function, comprising:

a printing mechanism including a ribbon cartridge, the ribbon cartridge comprising:

an ink ribbon;

a cartridge main body which stores the ink ribbon so as to expose a part of the ink ribbon;

a ribbon guide which is engaged with the exposed part of the ink ribbon so as to guide the exposed part; and a guide tape which forms a loop so as to support the ribbon guide while having one end in a longitudinal direction fixed to a first position on the ribbon guide and having the other end fixed to a second position on the ribbon guide and which is disposed so that a surface of the guide tape can face a surface of the exposed part of the ink ribbon;

wherein the guide tape passes through the cartridge main body.

10. The multiple functions peripheral according to claim 9, wherein:

the ink ribbon is exposed from the cartridge main body through a first opening and a second opening in the cartridge main body; and the guide tape passes inside the cartridge main body through the first and second openings.

11. The multiple functions peripheral according to claim 9, wherein the ink ribbon is disposed inside the loop formed by the guide tape.

12. The multiple functions peripheral according to claim 9, wherein the cartridge main body has a partition wall between a storage part for the ink ribbon and a passage of the guide tape.

13. The multiple functions peripheral according to claim 9, wherein:

the cartridge main body further includes one or more guide rollers: and each of the guide rollers guides the guide tape passing inside the cartridge main body.

14. The multiple functions peripheral according to claim 9, wherein a tape width of the guide tape is at least as large as a ribbon width of the ink ribbon.

15. The multiple functions peripheral according to claim 9, wherein the guide tape comprises a material selected from a group consisting of polyimide, biaxially oriented polyester, and biaxially oriented PPS (polyphenylene sulfide).

16. The multiple functions peripheral according to claim 9, wherein the guide tape has a rupture strength of not less than 170 MPa, a rupture elongation of not less than 70%, and a Young's modulus of not less than 3 GPa.

* * * * *